US007927265B2

(12) United States Patent
Stock et al.

(10) Patent No.: US 7,927,265 B2
(45) Date of Patent: Apr. 19, 2011

(54) RESISTANCE TRAINING APPARATUS

(75) Inventors: Clifford A Stock, Lee's Summit, MO (US); Glen Heman, Levasy, MO (US)

(73) Assignee: C & G Synergistics, Inc

( * ) Notice: Subject to any disclaimer, the term of this patent is extended or adjusted under 35 U.S.C. 154(b) by 61 days.

(21) Appl. No.: 12/391,424

(22) Filed: Feb. 24, 2009

(65) Prior Publication Data

US 2010/0216611 A1 Aug. 26, 2010

Related U.S. Application Data

(60) Provisional application No. 61/069,421, filed on Mar. 14, 2008.

(51) Int. Cl.
*A63B 21/015* (2006.01)

(52) U.S. Cl. ..... 482/118; 482/114

(58) Field of Classification Search ..... 482/44–49, 482/63–65, 114–120
See application file for complete search history.

(56) References Cited

U.S. PATENT DOCUMENTS

| | | | | |
|---|---|---|---|---|
| 3,953,025 | A | 4/1976 | Mazman | |
| 4,007,927 | A * | 2/1977 | Proctor | 482/63 |
| 4,408,759 | A * | 10/1983 | Reneau et al. | 482/114 |
| 4,436,303 | A | 3/1984 | McKillip | |
| 4,655,452 | A | 4/1987 | Huerstel | |
| 4,728,102 | A * | 3/1988 | Pauls | 482/118 |
| 4,741,529 | A | 5/1988 | Bloemendaal | |
| 5,154,684 | A | 10/1992 | Delf | |
| 5,833,575 | A | 11/1998 | Holslag | |
| 6,066,077 | A | 5/2000 | Horst | |
| 6,491,606 | B1 * | 12/2002 | Swift | 482/57 |
| 6,561,537 | B1 | 5/2003 | Chen | |
| 6,745,873 | B1 | 6/2004 | Chen | |
| 2002/0086779 | A1 | 7/2002 | Wilkinson | |
| 2006/0094569 | A1 | 5/2006 | Day | |
| 2009/0156362 | A1 * | 6/2009 | Berg | 482/2 |

FOREIGN PATENT DOCUMENTS

WO WO 8801526 A1 * 3/1988

* cited by examiner

*Primary Examiner* — Loan Thanh
*Assistant Examiner* — Daniel F Roland
(74) *Attorney, Agent, or Firm* — David E Herron, II

(57) ABSTRACT

The disclosure shows and describes a resistance training apparatus that enables one to use a single machine to exercise antagonistic muscle groups by enabling one to select a first level of resistance in a first direction and select a second level of resistance in a second direction. The apparatus will include a frame assembly, and shaft rotatably mounted to the frame assembly. The apparatus has first and second disks, first and second calipers respectively engaging the disks, and first and second adjustment means that respectively provide varying resistance when one imparts rotating torque is imparted to a first direction or second direction, respectively.

14 Claims, 5 Drawing Sheets

RESISTANCE TRAINING APPARATUS

SUMMARY OF THE INVENTION

The invention is a resistance training apparatus having a frame assembly and a shaft rotatably mounted to it. The apparatus will also have a first disk mounted to the shaft, and a first one way clutch configured to transfer rotating torque from the shaft to the first disk in a first direction. This first clutch allows only allows rotation when rotating torque is imparted to the shaft in the first direction.

A first caliper frictionally engages the first disk. In that regard, the invention will include a first adjustment means that allows one to selectively adjust an amount of frictional resistance that the first caliper imparts onto the first disk.

The invention also includes a second disk mounted to the shaft. In a like manner, the invention will have a second one way clutch that transfers rotating torque to the second disk in a second direction. The second clutch, however, will only transfer rotating torque to the second disk when shaft is rotated in the second direction.

The invention will also have a second caliper that frictionally engages the second disk. Analogously, the invention will include a second adjustment means that allows one to selectively adjustment an amount of frictional resistance that the second caliper imparts onto the second disk.

It is preferred that the each of the adjustment means be similar, yet independent. In that regard, each of the first and second adjustment means will preferably include a actuator adjustment wheel having coupled to an actuator housing, preferably at a hollow hub that extends from the actuator adjustment wheel. The adjustment means will also require an actuator shaft positioned within the housing such that its first end extends from the housing to engage a respective caliper piston. The shaft also passes through the hollow hub such that its second end extends outwardly a distance from the actuator adjustment wheel.

The adjustment means of the invention further includes a spring that biases the shaft into engagement with the respective caliper. By rotating the adjustment wheel, frictional resistance is selectively varied because the rotation of the wheel changes the position of the wheel along a longitudinal axis of the shaft, thereby changing the biasing force of the actuator shaft onto the respective caliper piston.

In a preferred embodiment of the invention, the resistance training apparatus will include an actuator adjustment bearing positioned within the hollow hub of the actuator wheel. The actuator adjustment bearing has an opening allowing the shaft to pass there through. Additionally, a plurality of detents is formed on the actuator adjustment bearing. In this embodiment, a plurality of apertures (or vessels) are formed on the actuator adjustment wheel, and a respective spring plunger is positioned within at least one of the respective apertures. The wheel, aperture, bearing, and spring plunger are all cooperatively configured so that each spring plunger, which is biased into contact with the bearing, creates a tactile feedback signal as the spring plunger passes over the detents when the actuator adjustment wheel is turned. This tactile feedback signal will only be realized when sufficient friction between the spring and bearing are achieved to overcome the bias of a spring plunger against a bearing detent.

In a preferred embodiment of the invention, apertures that house the spring plungers pass through the actuator adjustment wheel and handles extend outwardly from each aperture. In this embodiment, the spring plunger is biased inwardly toward the actuator adjustment bearing such that it passes over the plurality of detents as the actuator adjustment wheel is rotated.

The spring plungers passing over the detents provide a means for giving a tactile signal when the actuator adjustment wheel is rotated. Other means, however, are certainly possible and within the scope and spirit of the invention.

A threaded coupling connects the actuator housing to the actuator adjustment wheel. Rotation of the actuator adjustment wheel, therefore, selectively moves the actuator adjustment wheel along a longitudinal axis of the actuator adjustment shaft, which passes through the wheel. Thus, the movement varies the space between a terminal end of the actuator adjustment wheel and the actuator adjustment housing and further selectively varies the biasing force imparted by the spring that engages both the wheel and the shaft.

In a preferred embodiment, indicia (such as colored, annular rings) are etched on the second end of the actuator shaft. As the adjustment wheel is rotated, the distance the second end extends outwardly from the wheel varies. The indicia, therefore, enable one to visually observe this distance with greater ease. This distance is directly correlated to the bias of the spring against the caliper piston and therefore the frictional resistance created by the caliper and disk coupling. The indicia, therefore, enable one to visually observe this spring bias and proportionate frictional resistance with greater ease.

The invention imparts the principle of allowing one to use a single machine to work antagonistic muscle groups by providing resistance in two different directions. In that regard, the machine provides the capability for independent adjustment of these separate directions. For example, the frame assembly may form a leg exercising machine (as shown) that enables a first resistance in a leg extension direction, but a second resistance in a leg curl direction. Additionally, a frame assembly forming an arm exercise machine that allows one to choose a first resistance in the bicep curl direction, and a second resistance in a tricep extension direction. Analogously, the invention may be incorporated into a frame assembly that allows one to perform a chest press, upward using a first resistance, then a lat-pull, downward movement using a second resistance.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
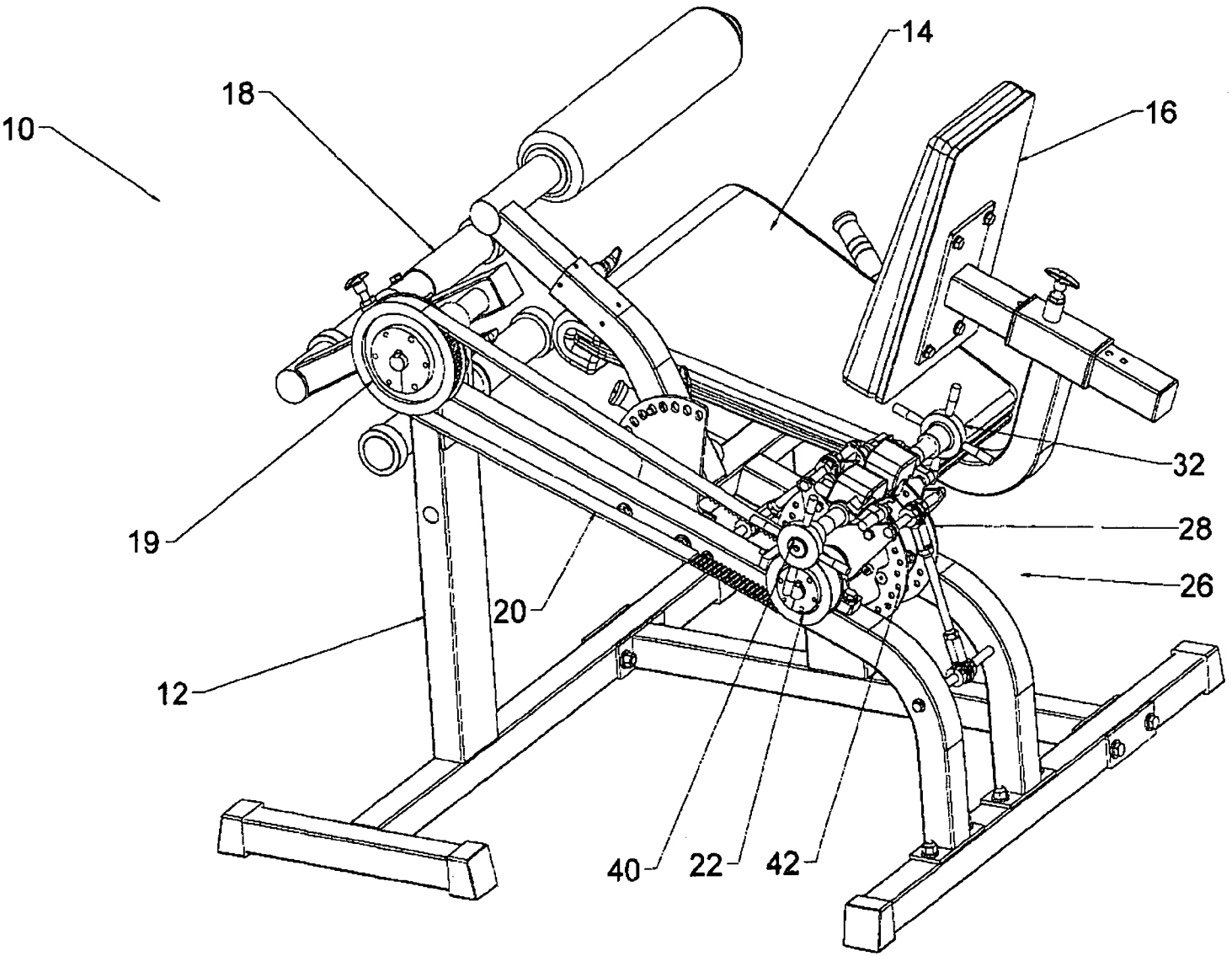
FIG. 1 is a perspective view showing the resistance training apparatus, according to the principles of the invention.

FIG. 1 is a perspective view of the inventive resistance training apparatus 10, according to the principles of the invention. As shown, the apparatus 10 forms a basic leg extension machine having a frame assembly 12 that supports a seat 14 and a back 16. As will become apparent as further embodiments are discussed, the inventive concept of a dual-directional resistance training apparatus 10 can incorporate any well-known resistance training apparatus, such as fly machines, a bench-press machine (with antagonistic rowing movement resistance), a military press (with antagonistic movement of lat-pull) machine, or the like.

Still referring to FIG. 1, the apparatus 10 also bears a pair of rollers 18 for engaging the user's feet or ankles. When a user moves the rollers 18, movement is imparted to driving wheel 19, and the rotation is transferred via belt 20 to a driven wheel 22, which is coupled to a shaft 24 (shown aft).

As shown in FIG. 1, the resistance assembly 26 includes a first disk 28 and a second disk 42, each coupled to the shaft 24. A first linear actuator apparatus 32 is configured to selectively vary the frictional resistance that a first caliper (not viewable in FIG. 1, but viewable aft) imparts onto the first disk 28. A second linear actuator apparatus 40 is configured to selectively vary the frictional resistance that a second caliper (not viewable in FIG. 1, but viewable aft) imparts onto the second disk 42.

Figure 2:
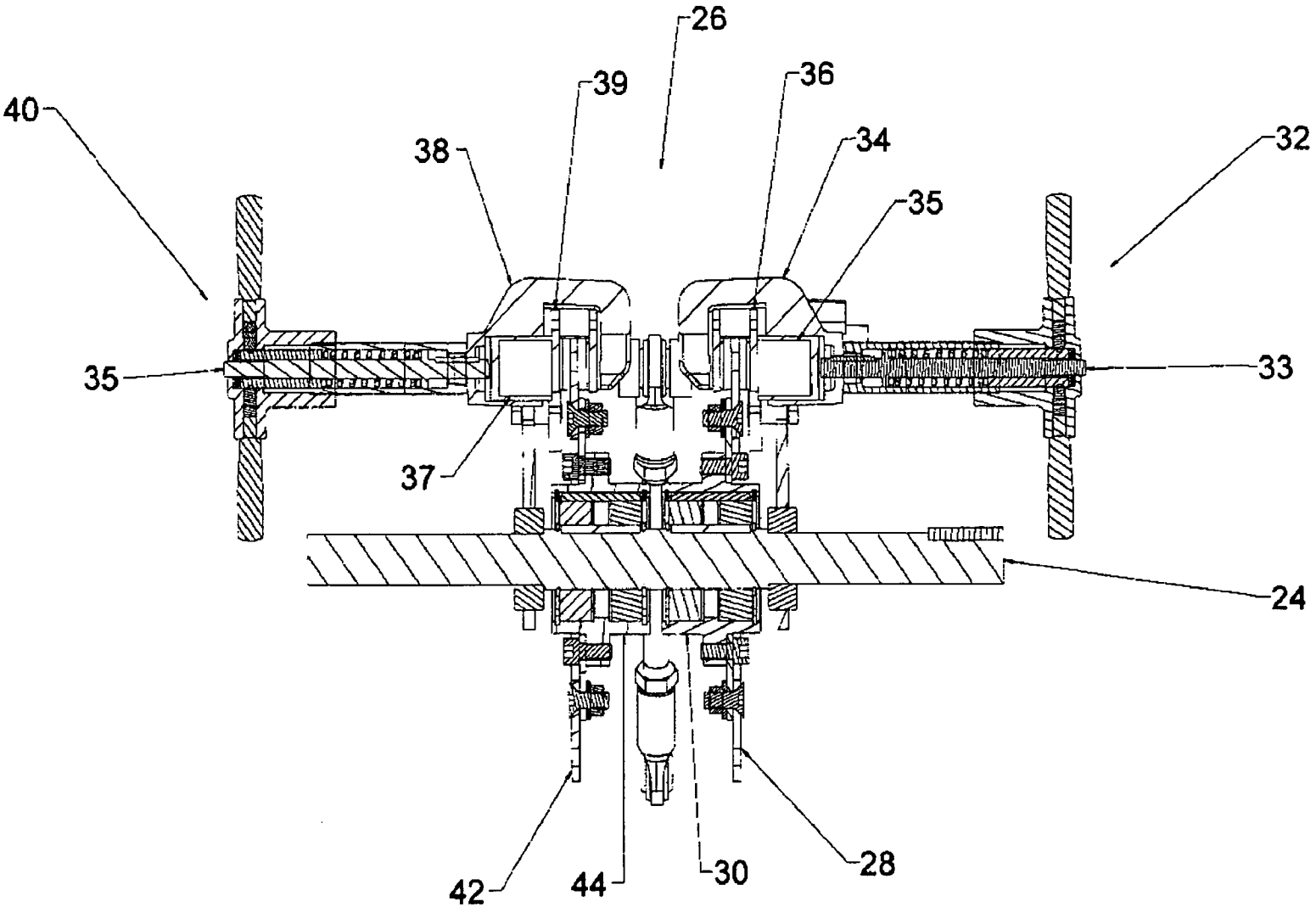
FIG. 2 is a cross-sectional view of the disk rotors, calipers, and linear actuator mechanisms.

FIG. 2 shows a cross-sectional detail of the resistance apparatus 26 coupled to the shaft 24. The resistance apparatus will include a first disk 28 coupled to a first clutch bearing assembly 30, each mounted to the shaft 24. The first clutch bearing assembly 30 is configured to allow rotation of the shaft 24 only in a first direction (i.e., clockwise).

The first disk 28 frictionally engages a first caliper apparatus 34 with a frictional force that may be varied by the first linear actuator apparatus 32. The first linear actuator apparatus 32 includes a linear actuator shaft 33 that engages the caliper piston 35, which in turn urges the caliper pads 36 into contact with the first disk 28.

Still referring to FIG. 2, the resistance apparatus 26 will also include a second disk 42 coupled to a second clutch bearing assembly 44, each mounted to the shaft 24. The second clutch bearing assembly is configured to allow rotation of the shaft 24 only in a second direction (i.e., counterclockwise). The second disk 42 frictionally engages a second caliper apparatus 38 with a frictional force that may be varied by the second linear actuator 40.

As shown in FIG. 2, the second linear actuator 40 includes a second linear actuator shaft 35 that engages the caliper piston 37 of the second caliper apparatus 38, thereby urging the caliper pads 39 of the second caliper apparatus into contact with the second disk 42.

Figure 3:
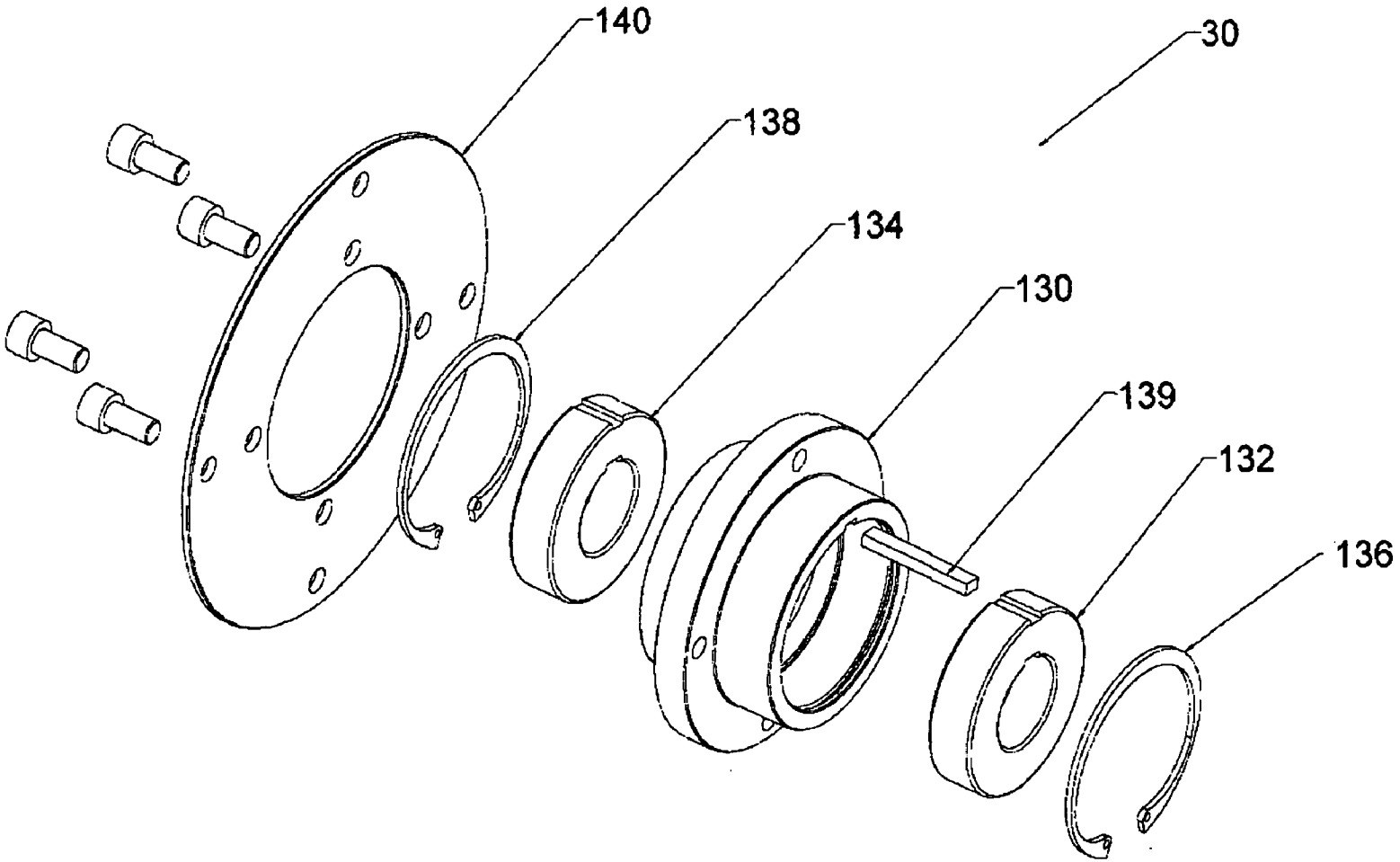
FIG. 3 is a perspective and exploded view isolating the parts of a one-way clutch assembly.

FIG. 3 is a perspective view isolating the clutch bearing assembly 30. As noted in FIG. 2, the resistance apparatus 26 has a first clutch bearing assembly 30 and a second clutch bearing assembly 44. It is to be understood that each of the clutch bearing assemblies bear analogous parts, and separate discussion of each would be repetitive. For the sake of brevity, the detail is discussed with regard to the first clutch bearing assembly 30. The first clutch bearing assembly 30 will include a bearing housing 130 positioned between a primary clutch bearing 132 and a secondary clutch bearing 134. A primary retaining ring 136 and a secondary retaining ring 138 are respectively positioned adjacent the primary clutch bearing 132 and secondary clutch bearing 134.

As shown in FIG. 3, each of the primary clutch bearing 132, secondary clutch bearing 134 and an inner surface of the clutch housing 130 bear a slot that is configured to receive a key 139. Additionally the clutch bearing assembly 30 will also include a rotor adapter 140 coupled to the clutch housing 130 on a first face, and coupled to the first disk 28 (see FIG. 2) on its opposite face. In this way, the clutch bearing assembly 30 will rotate with the shaft ONLY when the shaft is turned in a first direction, and will "freewheel" (i.e., not engage) when the shaft is turned in a second direction.

Figure 4:
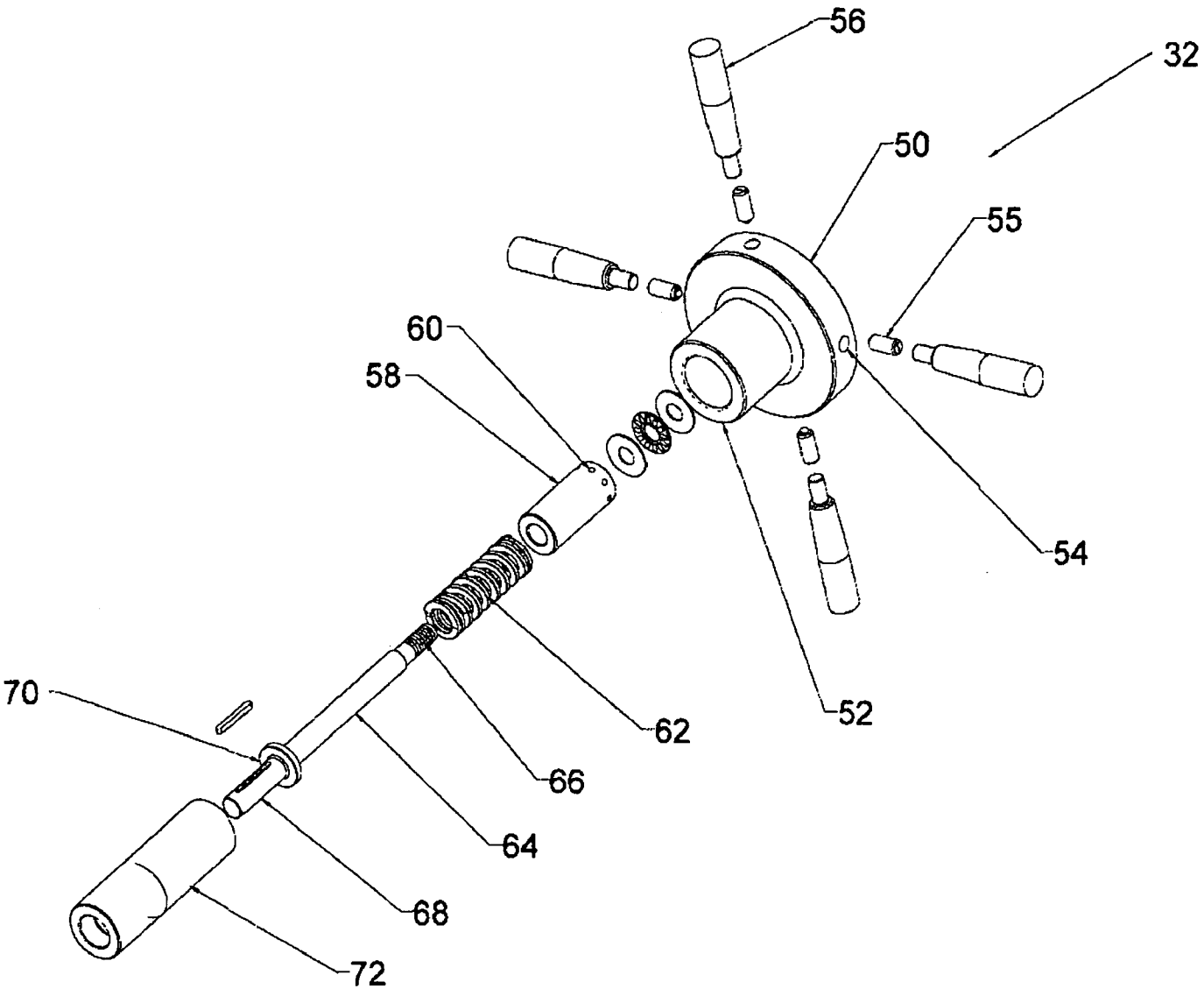
FIG. 4 is a perspective and exploded view showing the parts of the linear actuator mechanism.

FIG. 4 is a perspective view that isolates the first linear actuator mechanism 32. For the sake of brevity, the first linear actuator mechanism is shown in this detailed view, but it is to be understood that each of the first 32 and second 40 linear actuator mechanisms bear analogous parts. The first linear actuator mechanism 32 will have an actuator adjustment wheel 50 bearing a hub 52. The actuator adjustment wheel 50 has a plurality of apertures 54 around its periphery. As shown, a spring plunger 55 fits within each respective aperture 54, and a handle 56 is then inserted into the apertures atop the spring plunger 54.

As shown in FIG. 4, the linear actuator mechanism 32 will include an actuator shaft 64 having a first end 68 and a second end 66 having indicia (such as etched annular rings, as shown), and a raised portion 70 positioned near the first end 68. The actuator shaft will pass through a compression spring 62 and an actuator bearing 58 that has detents 60 formed adjacent its terminal end. When the linear actuator mechanism 32 is assembled, the spring plungers 55 will engage the bearing 58 and will pass over the detents 60 formed on the bearing 58, thereby emitting a tactile signal as the actuator adjustment wheel 50 is rotated.

As shown in FIG. 4, the linear actuator mechanism 32 will also include an actuator housing 72 that will couple to the hub 52 of the actuator wheel 50 by a threaded connection. Consequently, the actuator housing 72 will attach to the caliper apparatus (Ref No 34 in FIG. 2) at one end, and the actuator wheel 50 at the other. When assembled, the first end 68 of the actuator shaft will pass through the actuator housing 72 to engage the caliper piston (Ref 35 in FIG. 2).

Figure 5:
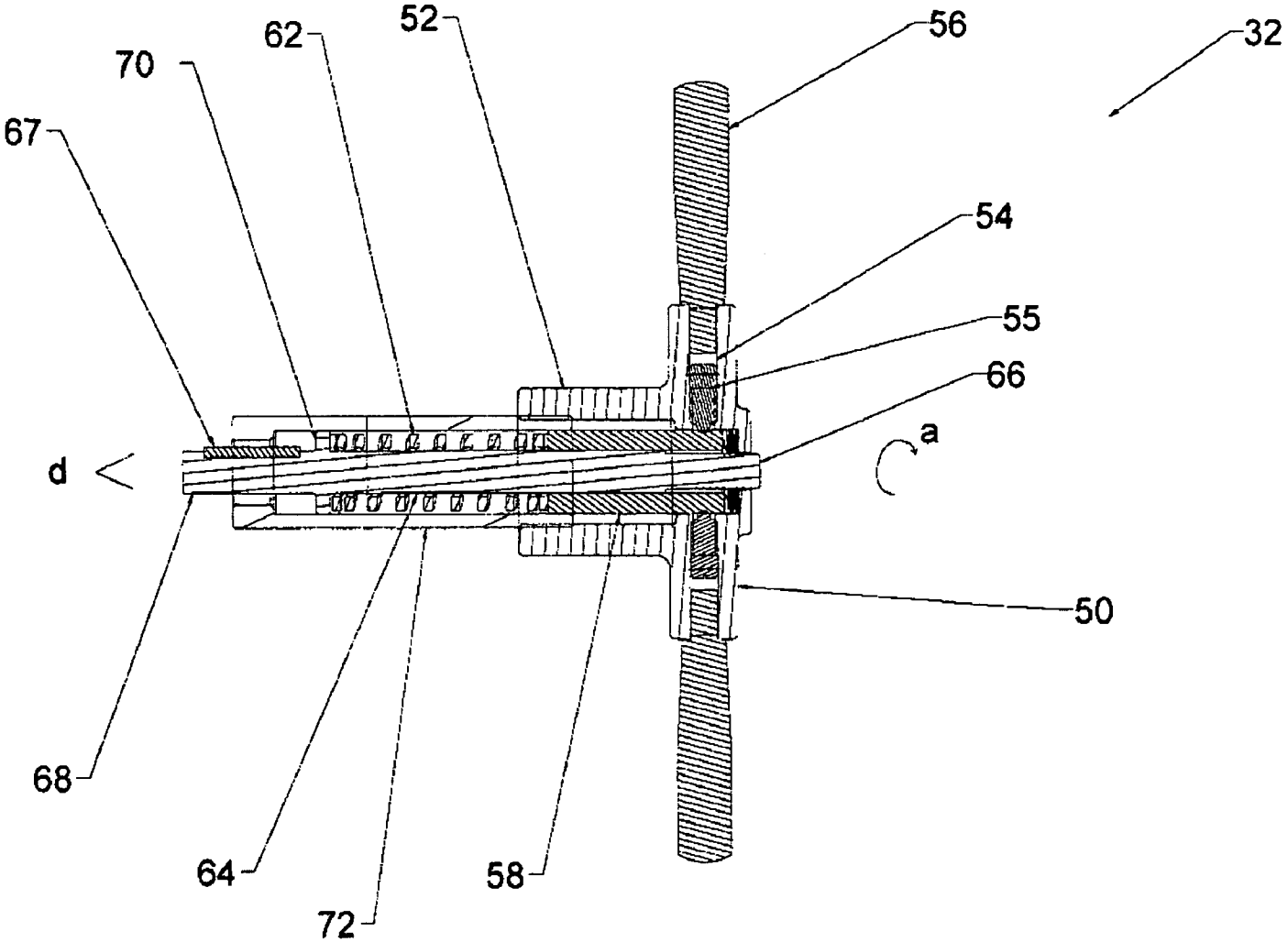
FIG. 5 is a cross-sectional view of the linear actuator mechanism

FIG. 5 shows a cross-sectional view of the fully-assembled first linear actuator apparatus 32. The actuator apparatus 32 includes an actuator wheel 50 having handles 56 inserted into apertures 54 that also house spring plungers 55, which are biased into engagement with the bearing 58. When the actuator wheel 50 is rotated, the spring plungers 55 pass along the surface of the bearing and engage within detents 60 on the bearing 58, thereby creating a tactile signal. Additionally, as the actuator wheel 50 is rotated in a clockwise direction A about the longitudinal axis of the actuator shaft 64, the threaded coupling that joins the hub 52 of the wheel 50 to the actuator housing 72 will urge the wheel in direction d, thereby compressing the spring 62 toward the raised portion 70 of the actuator shaft 64, which also biases the actuator shaft 64 in direction d.

Still referring to FIG. 5, a portion of the first end 68 of the actuator shaft 64 extends outwardly of the actuator housing to engage the caliper piston (35; see FIG. 2), which will thereby increase the frictional force exerted upon the first disk (28; see FIG. 2). As the wheel is rotated in direction A so that it travels in direction d, the second end 66 of the actuator shaft protrudes outwardly a distance from the actuator wheel 50. The second end 66 may bear indicia that facilitate visual clues as to how much biasing force the actuator shaft 64 puts on the caliper piston.

The distance that the second end 66 extends is directly correlated to the bias on the spring and therefore the frictional resistance created by the caliper and disc, which is translated into the resistance force felt by the user of the equipment. Generally, the indicia will be annular rings of varying colors. This feature makes it possible for the user to set the same resistance level when returning to the machine on the next workout. Without this observable feature, the user would need to make multiple adjustments until the resistance "felt" correct.

Additionally, the tactile signal emitted by the spring plungers adds even greater sensitivity and accuracy in the adjustment of the frictional resistance. For example, a user could desire to turn the wheel until the red indicator was exposed on the second end, then continue turning until two (or more) tactile cues were emitted. The combination of the indicia and the detents gives much more repeatability to the user. Additionally, the combination of detents and indicia will provide a predictability and uniformity of resistance that is independent of pad wear.

Having described and illustrated the invention in detail, it is to be understood that the above and foregoing is for illustration and demonstration only. The descriptions herein are not intended to limit the breadth of this invention. The breadth and scope of the invention shall be limited only by claims.

We claim:

1. A resistance training apparatus comprising:

a frame assembly;

a shaft rotatably mounted to the frame assembly;

a first disk mounted to the shaft, and a first one way clutch configured to transfer rotating torque to the first disk in a first direction only when rotating torque is imparted to the shaft in the first direction;

a second disk mounted to the shaft, and a second one way clutch configured to transfer rotating torque to the second disk in a second direction only when rotating torque is imparted to the shaft in the second direction;

a first caliper frictionally engaging the first disk;

a first adjustment means for allowing selective adjustment of frictional resistance imparted by the first caliper onto the first disk;

a second caliper frictionally engaging the second disk;

a second adjustment means for allowing selective adjustment of frictional resistance imparted by the second caliper onto the second disk; wherein, the first and second adjustment means each include:

an actuator housing, an actuator adjustment wheel with a hollow hub, the actuator wheel coupled to the actuator housing at the hub, an actuator shaft positioned within the housing such that its first end extends from the housing to engage a respective caliper piston, the shaft positioned to pass through the hollow hub such that its second end extends outwardly a distance from the actuator adjustment wheel, and, a spring configured to bias the shaft into engagement with the respective caliper piston, and wherein rotation of the actuator adjustment wheel selectively varies a biasing force of the actuator shaft onto the respective caliper piston.

2. The resistance training apparatus of claim 1, further comprising an actuator adjustment bearing positioned within the hollow hub of the actuator wheel;

an opening passing through the actuator adjustment bearing such that the actuator shaft can pass therethrough.

3. The resistance training apparatus of claim 2, further including a plurality of detents formed on the actuator adjustment bearing; and, a plurality of apertures formed on the actuator adjustment wheel;

a respective spring plunger positioned within at least one of the respective apertures; and, handles extending outwardly from each aperture; wherein, the spring plunger is biased inwardly toward the actuator adjustment bearing such that it passes over the plurality of detents as the actuator adjustment wheel is rotated and sufficient fiiction is created between the spring and bearing to overcome the spring plunger bias.

4. The resistance training apparatus as in claim 2, further comprising a means for creating a tactile signal as rotating torque is imparted to the actuator adjustment wheel.

5. The resistance training apparatus as in claim 1, further comprising a threaded coupling joining the actuator housing to the actuator adjustment wheel, such that rotation of the actuator adjustment wheel selectively varies a space between a terminal end of the actuator adjustment wheel and the actuator adjustment housing and further selectively varies the biasing force of the spring.

6. The resistance training apparatus as in claim 5, wherein, rotation of the actuator adjustment wheel selectively varies a position of the actuator adjustment wheel along a longitudinal axis of the actuator adjustment shaft, thereby varying the distance the second end extends outwardly from the actuator adjustment wheel which is directly correlated to the bias of the spring against the actuator shaft.

7. The resistance training apparatus as in claim 6, further including indicia on the second end of the actuator shaft; wherein as the actuator adjustment wheel is rotated, the distance the second end extends outwardly becomes readily observable.

8. The resistance training apparatus as in claim 1, the frame assembly forming a leg exercising machine, the machine enabling selection of a first resistance in a leg extension direction, and a second resistance in a leg curl direction.

9. The resistance training apparatus as in claim 1, the frame assembly forming a press machine, the machine enabling selection of a first resistance in the military press direction, and a second resistance in a lat pull direction.

10. A resistance training apparatus comprising:

a frame assembly;

a shaft rotatably mounted to the frame assembly;

a disk mounted to the shaft;

a caliper frictionally engaging the first disk;

an adjustment means for allowing selective adjustment of frictional resistance imparted by the caliper onto the disk, the adjustment means including an actuator housing;

an actuator adjustment wheel with a hollow hub, the actuator wheel coupled to the actuator housing at the hub;

an actuator shaft positioned within the housing such that its first end extends from the housing to engage the caliper, the actuator shaft passing through the hollow hub such that a second end of the actuator shaft extends outwardly a distance from the actuator adjustment wheel;

a spring configured to bias the shaft into engagement with the caliper;

indicia on the second end of the actuator shaft, the indicia enabling visual inspection of the distance the second end extends outwardly from the actuator adjustment wheel, the distance being directly correlated to a biasing force the spring imposes upon the actuator shaft;

and wherein rotation of the actuator adjustment wheel selectively varies the biasing force of the actuator shaft onto the caliper.

11. The resistance training apparatus as in claim 10, further comprising:

a threaded connection coupling the actuator adjustment wheel to the housing, whereby the rotation of the actuator adjustment wheel relative to the actuator housing creates relative movement of the wheel along a longitudinal axis of the actuator shaft.

12. The resistance training apparatus as in claim 10, further comprising a means for creating a tactile feedback signal as the actuator adjustment wheel is rotated relative to the actuator housing only after the spring is fully engaged with the actuator shaft and bearing.

13. The resistance training apparatus as in claim 12, the means for creating a tactile feedback signal including:

an actuator adjustment bearing positioned within the hollow hub of the actuator wheel;

a plurality of detents formed on the actuator adjustment bearing; and, a vessel formed on the actuator wheel;

a spring plunger positioned within the vessel and biased into engagement with the actuator adjustment bearing, wherein the spring plunger passes over the detents as the actuator adjustment wheel is rotated, thereby creating a tactile feedback signal as the wheel is rotated.

14. A resistance training apparatus comprising:

a frame assembly;

a shaft rotatably mounted to the frame assembly;

a first disk mounted to the shaft, and a first one way clutch configured to transfer rotating torque to the first disk in a first direction only when rotating torque is imparted to the shaft in the first direction;

a second disk mounted to the shaft, and a second one way clutch configured to transfer rotating torque to the second disk in a second direction only when rotating torque is imparted to the shaft in the second direction;

a first caliper frictionally engaging the first disk;

a first adjustment means for allowing selective adjustment of frictional resistance imparted by the first caliper onto the first disk;

a second caliper frictionally engaging the second disk;

a second adjustment means for allowing selective adjustment of frictional resistance imparted by the second caliper onto the second disk; wherein, the first and second adjustment means each include:

an actuator housing, an actuator adjustment wheel with a hollow hub, the actuator wheel coupled to the actuator housing at the hub, an actuator adjustment bearing positioned within the hollow hub of the actuator wheel, an opening passing through the actuator adjustment bearing and enabling the actuator shaft to pass therethrough, an actuator shaft positioned within the housing such that its first end extends from the housing to engage a respective caliper piston, the shaft positioned to pass through the hollow hub such that its second end extends outwardly a distance from the actuator adjustment wheel;

a plurality of detents formed on the actuator adjustment bearing;

a plurality of apertures formed on the actuator adjustment wheel;

a respective spring plunger positioned within at least one of the respective apertures; and, handles extending outwardly from each aperture; and, a spring configured to bias the shaft into engagement with the respective caliper piston; wherein rotation of the actuator adjustment wheel selectively varies a biasing force of the actuator shaft onto the respective caliper piston, and wherein, the spring plunger is biased inwardly toward the actuator adjustment bearing such that it passes over the plurality of detents as the actuator adjustment wheel is rotated and sufficient friction is created between the spring and bearing to overcome the spring plunger bias.

* * * * *